US008141171B2

(12) United States Patent
Milman

(10) Patent No.: US 8,141,171 B2
(45) Date of Patent: Mar. 27, 2012

(54) SPLIT COWL NECK BIB

(76) Inventor: April Robin Milman, Old Westbury, NY (US)

( * ) Notice: Subject to any disclaimer, the term of this patent is extended or adjusted under 35 U.S.C. 154(b) by 0 days.

(21) Appl. No.: 12/832,784

(22) Filed: Jul. 8, 2010

(65) Prior Publication Data

US 2012/0005800 A1 Jan. 12, 2012

(51) Int. Cl.
*A41B 13/10* (2006.01)

(52) U.S. Cl. ..... 2/49.1; 2/52

(58) Field of Classification Search ..... 2/46, 48, 2/49.1–49.5, 50, 51, 52, 468, 88, 91, 92, 2/103, 114, 90, 75, 80, 129, 131–134, 141.1, 2/207, 271, 913, 916

See application file for complete search history.

(56) References Cited

U.S. PATENT DOCUMENTS

| | | | | | |
|---|---|---|---|---|---|
| 191,924 | A | * | 6/1877 | Brown | 2/119 |
| 593,954 | A | * | 11/1897 | Way | 2/91 |
| 783,173 | A | * | 2/1905 | Brown | 2/91 |
| 783,867 | A | * | 2/1905 | Hyman | 2/91 |
| 985,441 | A | * | 2/1911 | Neuman | 2/91 |
| 1,391,121 | A | * | 9/1921 | Keppel | 2/49.5 |
| 2,364,568 | A | * | 12/1944 | Tiscornia | 2/50 |
| 2,900,640 | A | * | 8/1959 | Haydu | 2/49.1 |
| 3,099,013 | A | * | 7/1963 | Thorpe | 2/103 |
| D230,663 | S | * | 3/1974 | Fowler | D29/101.2 |
| 3,823,417 | A | * | 7/1974 | Cluckey | 2/91 |
| 4,458,364 | A | * | 7/1984 | Fenninger et al. | 2/50 |
| 4,718,123 | A | * | 1/1988 | Petropoulos | 2/91 |
| 4,780,912 | A | * | 11/1988 | Harmsen | 2/91 |
| 4,833,732 | A | * | 5/1989 | Harmsen | 2/102 |
| 4,975,982 | A | * | 12/1990 | Hughes | 2/49.1 |
| 5,035,006 | A | * | 7/1991 | Hetz et al. | 2/209.11 |
| 6,253,424 | B1 | * | 7/2001 | Rainville-Lonn | 24/306 |
| 6,532,596 | B1 | * | 3/2003 | Fosmo | 2/49.1 |
| 6,859,938 | B1 | * | 3/2005 | Niski et al. | 2/49.1 |
| 6,934,968 | B2 | * | 8/2005 | Kurpis | 2/49.1 |
| 7,448,089 | B2 | * | 11/2008 | Kelly | 2/49.1 |
| D591,484 | S | * | 5/2009 | Lindh | D2/864 |
| 7,526,815 | B1 | * | 5/2009 | Kelly | 2/49.1 |
| D597,726 | S | * | 8/2009 | Sacca | D2/600 |
| 2010/0132088 | A1 | * | 6/2010 | Bloom et al. | 2/49.1 |

FOREIGN PATENT DOCUMENTS

GB 2405572 * 3/2005

OTHER PUBLICATIONS

Gershman, Maurice. "Self-Adhering Nylon Tapes", Oct. 18, 1958, Journal of AMA, vol. 168, No. 7 (1 page).*

* cited by examiner

*Primary Examiner* — Amy Vanatta

(74) *Attorney, Agent, or Firm* — Oakwood Law Group, LLP; Yuchien Wei

(57) ABSTRACT

A bib portion with left and right top ends formed by a split circular opening and a cowl neck split along the back having a left side end with an inside surface and an outside surface and a right side end having an inside surface and an outside surface where a bottom end of the split cowl neck is attached around the split circular opening with the split in the split cowl neck aligned with the split in the split circular opening. Mating strips of a loop and hook connector are attached to left and right sides of the split in the cowl neck to closely position the split cowl neck around a child's neck and a loop of material is attached to a connector strip or a side end of the cowl neck split to function as a finger pull when separating the connector strips.

9 Claims, 3 Drawing Sheets

SPLIT COWL NECK BIB

BACKGROUND OF THE INVENTION

1. Field of the Invention

The present invention relates generally to child's bibs and more specifically to a cowl neck bib where the cowl neck is split along its back to provide a bib which is completely open along its back and has loop and hook fastening strips attached to the back of the split cowl neck. At least one of the fastening strips is attached to a loop which functions as a finger grip when separating the fastening strips.

2. Description of Related Art

Bibs for protecting children from spilled liquids and food while being fed is known in the prior art. More specifically, by way of example, U.S. PreGrant Publication No. 2001/0047532 to Marrero discloses a disposable bib having a liquid-permeable top layer, an absorbent inner-core, and a waterproof and air-permeable back layer. The top and back layers provide a C shaped collar. An adhesive bond is provided to attach the layers to each other to provide a cross-stitch pattern equivalent to quilting, to aid in controlling the expansion of the absorbent inner-core.

U.S. Pat. No. 7,526,815 to Kelly discloses a baby bib with a protective neck strap under a child's neck to ensure that the neckline is covered and protected from food and liquid spilled from a baby's mouth when feeding. A rear pocket can be turned inside-out onto the front of the bib to form a pouch and back straps secure the bib to the baby.

U.S. Pat. No. 7,469,424 to Good discloses a bib that includes an overlapping slit formed in the center of a lower section of a front panel. The open back allows the bib to be easily slipped on an already seated person without the need to stand.

U.S. Pat. No. 6,859,938 to Niski discloses a bib having a hoop made of memory material, a collar for fitting around a wearer's neck and a body portion for protecting the chest of the wearer. The hoop communicates with the collar and both the collar and hoop can be expanded to form a neck opening for placing on a wearer's neck. Upon releasing the expanding force on the hoop, the hoop contracts due to its memory material construction to provide an encircling force upon the collar to encircle the wearer's neck with a snug fit.

U.S. Pat. No. 6,493,879 to Hibler discloses a plurality of protective overlays arranged in a stack wherein individual flexible sheets may be separated from the stack, used, and then disposed or re-adhered to the stack for subsequent use.

U.S. Pat. No. 6,374,411 to Duhn discloses a bib for covering a person and/or clothing while eating, applying make-up, hair cutting or the like. The bib includes a neck attachment adjacent one end and a securing device adjacent the other end. The neck attachment secures one end of the protective device to the wearer and the securing device secures the other end of the protective device to the wearer, the wearer's attire or some other fixed point to restrict removal of the protective device.

U.S. Pat. No. 5,640,715 to Adams discloses a bib which can be moved between a folded up position and a folded down position. In the folded up position, the bib is attached to a body covering means by at least one fastener. A separate attachment holds the bib to the body covering means substantially along the waist of the wearer. In the folded down position a lined bib is provided which gives a measure of protection against spills of beverages, foods, paints, compounds, elements, industrial substances, and so on.

U.S. Pat. No. 4,975,982 to Hughes discloses a turtleneck bib having an elongated collar portion which is secured to the shield portion of the bib. The bib forms folds which contact the child's neck and prevent liquids from traveling under the collar. A horizontal pleat on the collar helps to form the nonrestrictive folds.

SUMMARY OF THE INVENTION

In an exemplary embodiment of the present invention, there is disclosed a cowl neck having a bib portion with left and right top ends formed by a split circular opening and a cowl neck split along the back having a left side end with an inside surface and an outside surface and a right side end having an inside surface and an outside surface where a bottom end of the split cowl neck is attached around the split circular opening with the split in the split cowl neck aligned with the split in the split circular opening. Mating strips of a loop and hook connector are attached to left and right sides of the split in the cowl neck to closely position the split cowl neck around a child's neck and a loop of material is attached to a connector strip or a side end of the cowl neck split to function as a finger pull when separating the connector strips.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
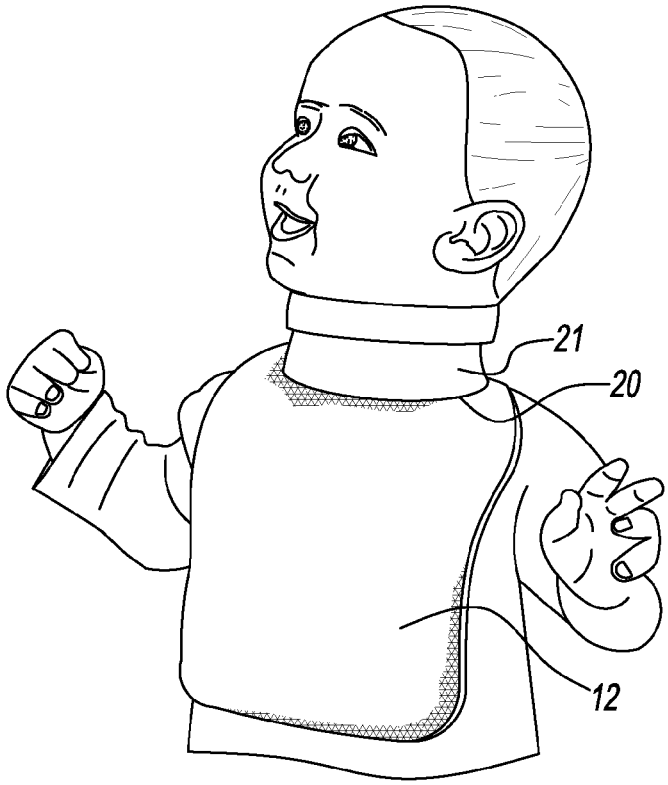
FIG. 1 is a perspective view of a split cowl neck bib located on a baby/child in accordance with the principles of the invention.

Referring to FIG. 1, there is disclosed a perspective view of a craw neck bib located on a baby/child in accordance with the principles of the invention.

As used herein the term split cowl neck is used as a for a high close fitting turnover collar with a slit down the back used especially for bibs.

The purpose of the bib is to keep a child's clothing dry while he/she is feeding or drinking. With most bibs, when a child is drinking, the liquid can drip underneath the bib and wet the child's clothing. The result is that the child's clothing underneath the bib gets wet and soiled and the child now wears at least a shirt that is damp and soiled.

The bib here disclosed covers the child's front chest area and continues up around the child's neck with a roll over neck cover which is here referred to as a split cowl neck.

The split cowl neck extends beyond the child's jaw and lower face, to catch any dripping liquid or food. The cowl neck can also have an absorbent padding located on either the outside surface or the inside surface to help keep liquids from dripping onto the child's neck and chest area. The entire bib is one piece can be made of woven or non-woven material where the cowl neck may be stretchable or non-stretchable. The cowl neck is split down the back to provide a left side end and a right side end and the slit cowl neck bib is completely open in the back to allow the bib to be easily and quickly placed around and removed from a child's neck.

In one embodiment of the invention, to quickly and easily attach the split cowl neck bib to a child, a loop and hook fastening means such as two strips of Velcro are permanently attached to the left and right side ends of the split cowl neck where one strip of the hook and loop fastener is located on the inside surface of the left side end of the split cowl neck and the other strip of Velcro with loops is located on the outside surface of the right side end of the split cowl neck. To attach the cowl neck bib to a child, the strip of Velcro on the inside surface on the left side end of the split cowl neck is placed on top of and pressed onto the strip of Velcro on the outside surface of the right side end of split cowl neck. To allow the split cowl neck bib to be quickly and easily removed from the child, the end of the strip of Velcro material on the inside surface of the cowl neck is located about an inch, more or less, in from the left side end of the split cowl neck to provide a free end, or a circular button hole may be located at the free end of the cowl neck. To remove the cowl neck bib from a child, an adult either grasps the free end of the cowl neck or places his/her finger into the circular button hole at the free end of the cowl neck and pulls to separate the Velcro strips. Thus, the free end on the Velcro strip, either with or without the circular button hole, provides a positive nonslip grip which allows the Velcro strips to be quickly and easily separated and the split cowl neck bib to be removed from a child. Should the bib accidentally get caught on an object it can be quickly and easily removed to reduce to possibility that the child may be injured.

In another embodiment of the invention, to quickly and easily attach the split cowl neck bib to a child, a loop and hook fastening means such as two strips of Velcro are permanently attached to the left and right side ends of the split cowl neck where one strip of the hook and loop fastener is located on the inside surface and in from the left side end of the split cowl neck by an inch, more or less, and the other strip of Velcro with loops is located on the inside surface and in from the right side end of the split cowl neck by an inch, more of less. Thus, the two strips of Velcro are attached to the inside surfaces at the ends of the split cowl neck. To attach the split cowl neck bib to a child, the strip of Velcro on the inside surface on the left end is placed next to and pressed onto the strip of Velcro on the inside surface at the right end of cowl neck. To allow the split cowl neck bib to be quickly and easily remove from the child, the end of the strip of Velcro on the inside surface at the left side end and right side end of the split cowl neck are located about an inch, more or less, in from their respective ends to provide free ends, each of which may have a circular button hole located at the free end of the split cowl neck. To remove the split cowl neck bib from a child, an adult either grasps the free ends of the split cowl neck or places his/her fingers into the circular button holes at the free ends of the split cowl neck and pulls the Velcro strips apart. Thus, should the cowl neck bib accidentally get caught on a fixed object as the child falls, the child's weight will automatically apply a pull to either the left or right ends of the split cowl neck which will urge the loop and hook fastening mean to be pulled apart. In addition, during normal use, the left and right ends of the split cowl neck can be separated from each other by placing a finger from each hand into the pull openings on the two strips and pulling. Thus, with this embodiment, in addition to being able to quickly and easily remove the bib from a child, the hook and loop fastener may also be pulled apart by the child's weight in the event that the bib gets caught during a fall to reduce the possibility that the child may be injured.

In another embodiment of the invention the strips of Velcro are replaced with a snap type of closure, a hook type of closure, a magnetic type of closure, a button type of closure, a tie string type of closure, an elastic loop that fits around a button, or any other type of closure without departing from the principles of the invention.

In another embodiment the bib can be of a size suitable for adults to use when, for example, eating lobsters, for general medical use, when sitting in a dentist chair and for geriatric use. In another embodiment a Velcro pull (not shown) can be located on the side of the bib to facilitate placing the bib on and removing the bib from bedridden individuals. Both the infant/child and adult size bib can be made of a disposable woven or non-woven fabric or material.

Figure 2A:
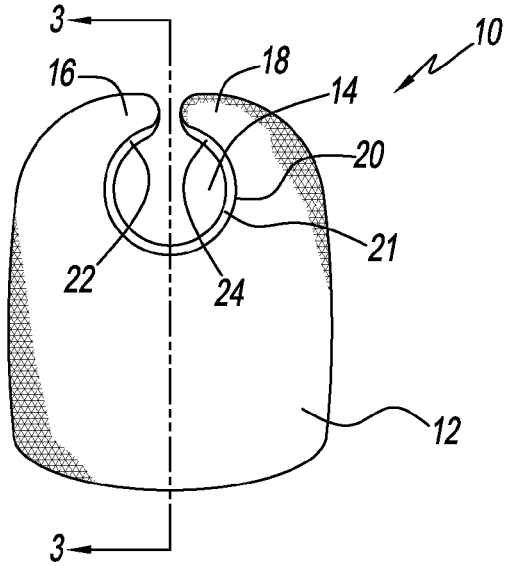
FIG. 2A is a front view of the split cowl neck bib in accordance with the principles of the invention.

Referring to FIGS. 1 and 2A, the cowl neck bib 10 has a bib section 12 which has a circular opening 14 that is split to provide a left side end 16 and a right side end 18 at the top of the bib section. Attached to the bib section around the edge of the circular opening 14 is a split cylindrical member 21 which is the split cowl neck of the cowl neck bib which is made of a soft pliable material where the left end of the split of the cylindrical member is aligned with the left end 16 of the opening 14 in the bib section and the right end of the split of the cylindrical member is aligned with the right end 18 of the opening 14 in the bib section. The split cylindrical member is the cowl neck of the cowl neck bib, and the cowl neck can be made of a cloth which may be stretchable or non-stretchable and which can be washed. The bib section 12 can be made of a single or double layer absorbent material such as a felt or a soft woven or nonwoven pliable material that may have a backing that is non-absorbent such as a soft pliable plastic.

In an embodiment of the invention the split cylindrical member and the bib may be made from a single continuous piece of non-woven material, or the bib section and the split cylindrical member may consist of two separate parts which are attached to each other by sewing or with an adhesive.

In another embodiment, the bib section may have a channel located around the edge of the circular opening which contains a split ring of soft pliable compressible material such as foam rubber which is located between the bib section and the split cylindrical member.

Figure 2B:
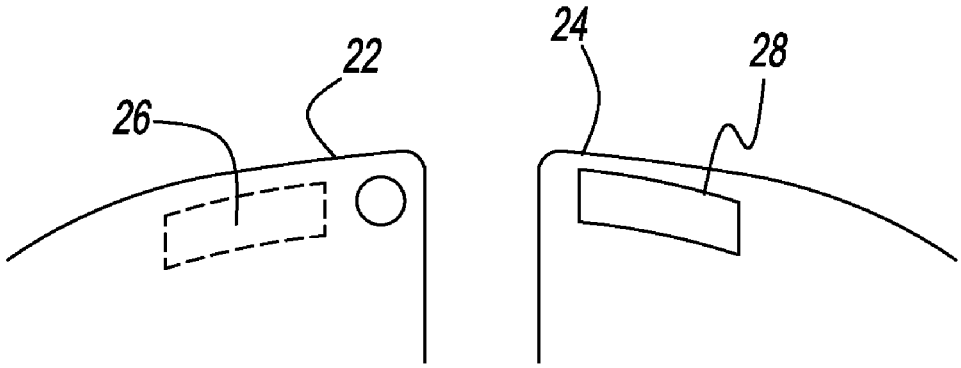
FIGS. 2B and 2C are two view of an embodiment of the split cowl neck bib where the ends of the split cowl neck are separated from each other and attached to each other.
Figure 2C:
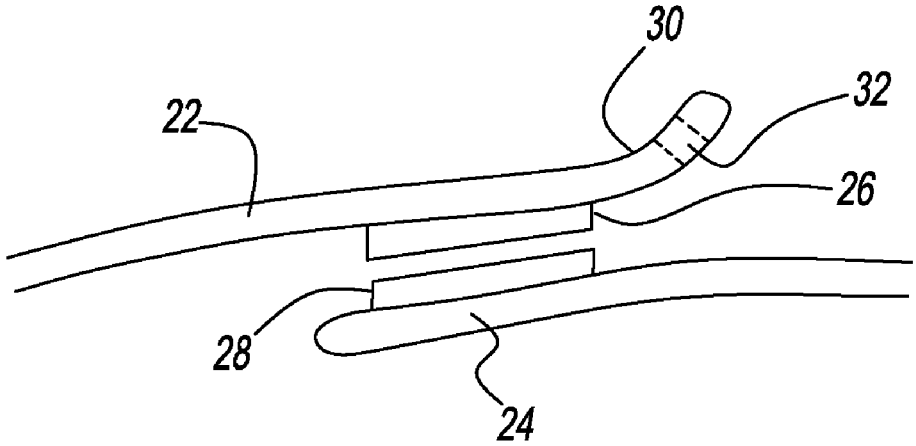

In an embodiment of the invention, a strip of Velcro is attached to the inside surface of the left side end 22 of the split cylindrical member 21 and a mating strip of Velcro is attached to the outside surface of the right side end 24 of the split cylindrical member 21. Referring to FIGS. 2B and 2C, there is shown a view of the ends of the split cylindrical member separated from each other and a view of the ends attached to each other. To quickly and easily attach the split cowl neck bib to a child, a loop and hook fastening means such as two strips of Velcro are permanently attached to the left and right ends of the split cowl neck where one strip 26 of the hook and loop fastener is located on the inside surface of the left end 22 of the split cowl neck and the other strip 28 of Velcro with loops is located on the outside surface of the right end 28 of the split cowl neck. To attach the cowl neck bib to a child, the strip 26 of Velcro on the inside surface on the left end 22 of the split cowl neck is placed on top of and pressed onto strip 28 of Velcro on the outside surface of the right end 24 of the split cowl neck. To allow the split cowl neck bib to be quickly and easily removed from the child, the strip 26 of Velcro material on the inside surface of the left end 22 of the cowl neck is located about an inch, more or less, in from the very end of the left end 22 of the split cowl neck to provide a free end 30 that may have a circular button hole 32. To remove the cowl neck bib from a child, an adult either grasps the free end 30 of the cowl neck or places his/her finger into the circular button hole 32 in the free end of the split cowl neck and pulls to separate the Velcro strips. Thus, the free end on the Velcro strip, either with or without the circular button hole, provides a positive nonslip grip which allows a person to quickly and easily separate the Velcro strips from each other and remove the split cowl neck bib form the child. Should the bib accidentally get caught on an object as the child falls, the bib can be quickly and easily removed to reduce to possibility that the child may be injured.

Figure 2D:
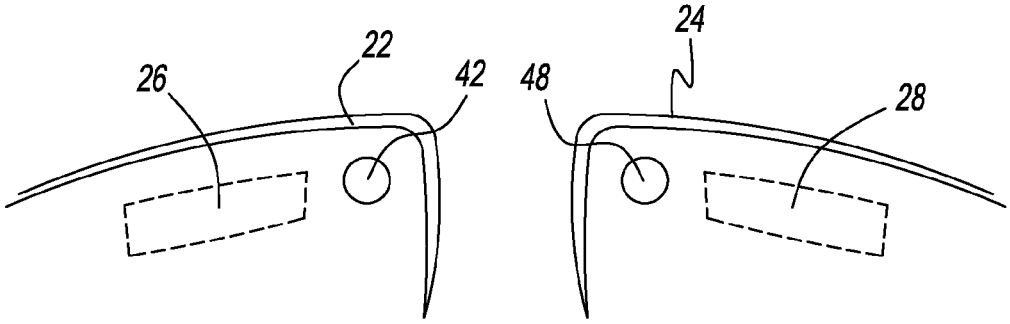
FIGS. 2D and 2E are two views of another embodiment of the split cowl neck where the ends of the split cowl neck are separated from each other and attached to each other.
Figure 2E:
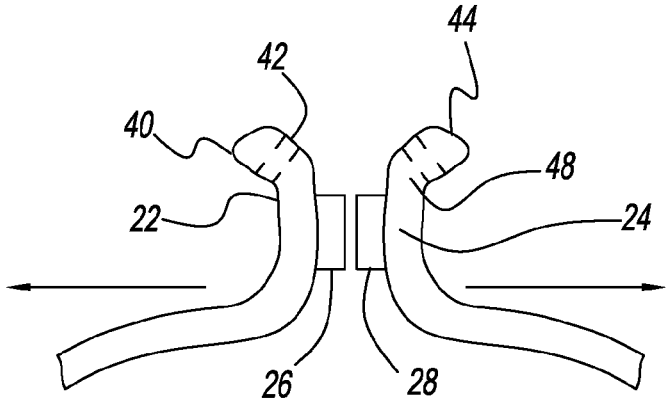

In another embodiment of the invention, a strip of Velcro is attached to the inside surface of the left end 22 of the split cylindrical member 21 and a mating strip of Velcro is attached to the inside surface of the right end 24 of the split cylindrical member 21. Referring to FIGS. 2D and 2E, there is shown a view of the ends of the split cylindrical member separated from each other and a view of the ends attached to each other. To quickly and easily attach the cowl neck bib to a child, a loop and hook fastening means such as two strips of Velcro are permanently attached to the left 22 and right 24 ends of the split cowl neck where one strip 26 of the hook and loop fastener is located on the inside surface and in from the end of the left end 22 of the split cowl neck by an inch, more or less, and the other strip 28 of Velcro with loops is located on the inside surface and in from the end of the right end 24 of the split cowl neck by an inch, more of less. Thus, both strips of Velcro are attached to the inside surfaces at the ends of the split cowl neck. To attach the split cowl neck bib to a child, the strip 26 of Velcro on the inside surface of the left end 22 of the cowl neck is placed next to and pressed onto the strip 28 of Velcro on the inside surface on the right end 24 of cowl neck. To allow the cowl neck bib to be quickly and easily remove from the child, the end of the strip 26 of Velcro on the inside surface at the left end 22 is located back from the very end of the end 22 of the split cowl neck about an inch, more or less, to provide a free end 40, which may have a circular button hole 42 located at the free end of the split cowl neck which is large enough to receive a person's finger. As with the end 22 of the cowl neck 21, the end 24 of the cowl neck has a strip of Velcro 28 attached to its inside surface, and a free end which may have a circular button hole finger grip. To remove the cowl neck bib from a child, an adult either grasps the free ends 40, 44 of the split cowl neck or places his/her fingers into the circular button holes 42, 48 at the free ends of the split cowl neck and pulls the Velcro strips apart. Thus, should the cowl neck bib accidentally get caught as the child falls, the pull on one of the ends of the split cowl neck by the child's weight will be opposite to the pull on the other end of the split cowl neck to urge the left and right ends of the split cowl neck and the loop and hook fastening mean to be pulled apart. In addition, during normal use, the left and right ends of the split cowl neck can be separated from each other by placing a finger from each hand into the pull openings on the two strips and pulling. Thus, with this embodiment, in addition to being able to quickly and easily remove the bib from a child, the hook and loop fastener may also be pulled apart by the child's weight in the event that the bib gets caught during a fall to reduce the possibility that the child may be injured.

Figure 3:
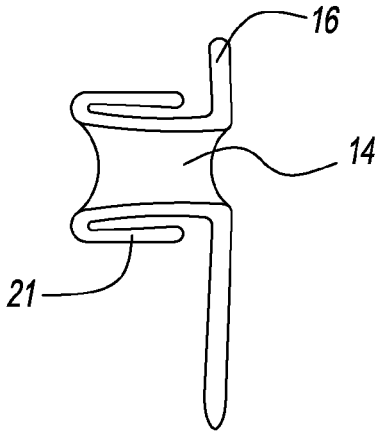
FIG. 3 is a side sectional view along the line 3-3 of the split cowl neck bib of FIG. 2A in accordance with the principles of the invention.

Referring to FIG. 3, there is shown a side sectional view along the line 3-3 of the cowl neck bib of FIG. 2A in accordance with the principles of the invention. In the embodiments here disclosed, the opening 14 can have a diameter of about four inches more or less and the height of the split cowl neck, when folded over, can be between four inches and seven inches, more or less.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A cowl neck bib comprising:

a bib portion having a left top end and a right top end formed by a split circular opening located therebetween;

a split along the back of the cowl neck and the full length of the back of the bib to provide a left side end with an inside surface and an outside surface and a right side end with an inside surface and an outside surface wherein a bottom end of the split cowl neck is attached to the bib portion around the split circular opening with the split in the split cowl neck aligned with the split in the split circular opening to provide a cowl neck bib that is completely open in the back;

a channel located around the edge of the cowl neck which contains a split ring of soft pliable compressible material; and mating strips of a loop and hook connector attached to left and right sides of the split cowl neck to closely position the split cowl neck of the split cowl neck bib around a child's neck.

2. The cowl neck bib of claim 1 wherein the bib and the split cowl neck is made of a woven or non-woven material.

3. The cowl neck bib of claim 2 wherein the split cowl neck is of a stretchable or non-stretchable material.

4. The cowl neck bib of claim 3 wherein the bib is made of cotton.

5. The cowl neck bib of claim 3 wherein a fluid resistant material is located on the inside surface of the bib.

6. The cowl neck bib of claim 3 wherein a layer of absorbent material is located on a surface of the split cowl neck.

7. The cowl neck bib of claim 3 wherein the outside surface of one of the side ends of the cowl neck split is attached to a connector strip and the inside surface of the other side end of the cowl neck split is attached to a mating connector strip which is adapted to overlay the connector strip; and wherein a loop of material is attached to the end of the connector strip that is attached to the mating connector strip and includes an opening that functions as a finger pull when separating the connector strips.

8. The cowl neck bib of claim 1 wherein the inside surface of one of the side ends of the cowl neck split is attached to a connector strip and the inside surface of the other side end of the cowl neck split is attached to a mating connector strip; and a loop of material is attached to the end of each connector strip wherein each loop includes an opening that functions as a finger pull when separating the connector strips.

9. A cowl neck bib comprising:

a bib portion having a left top end and a right top end formed by a split circular opening located therebetween;

a split along the back of the cowl neck and the full length of the back of the bib to provide a left side end with an inside surface and an outside surface and a right side end with an inside surface and an outside surface wherein a bottom end of the split cowl neck is attached to the bib portion around the split circular opening with the split in the split cowl neck aligned with the split in the split circular opening to provide a cowl neck bib that is completely open in the back; and mating strips of a loop and hook connector attached to left and right sides of the split cowl neck to closely position the split cowl neck of the split cowl neck bib around a child's neck;

wherein the bib and the split cowl neck is made of a woven or non-woven material;

wherein the split cowl neck is of a stretchable or non-stretchable material; and wherein the inside surface of one of the side ends of the cowl neck split is attached to a connector strip and the inside surface of the other side end of the cowl neck split is attached to a mating connector strip; and a strip of material is attached to the ends of each connector strip to provide two finger pulls for separating the connector strips.

* * * * *